United States Patent [19]

Keller et al.

[11] Patent Number: 4,945,843

[45] Date of Patent: Aug. 7, 1990

[54] SEWING MACHINE WORKPIECE ALIGNMENT DEVICE

[75] Inventors: Karl-Heinz Keller, Kaiserslautern; Mathias Staab, Steinwenden; Mathias Blum, Rockenback-Steegen, all of Fed. Rep. of Germany

[73] Assignee: Pfaff Industriemaschinen GmbH, Kaiserslautern, Fed. Rep. of Germany

[21] Appl. No.: 360,275

[22] Filed: Jun. 2, 1989

[30] Foreign Application Priority Data

Jun. 6, 1988 [DE] Fed. Rep. of Germany ... 8807378[U]

[51] Int. Cl.[5] ..... D05B 35/10

[52] U.S. Cl. ..... 112/148; 112/153

[58] Field of Search ..... 112/65, 70, 76, 121.12, 112/121.15, 148, 152, 153

[56] References Cited

U.S. PATENT DOCUMENTS 4,227,471 10/1980 Collbrunn et al. ..... 112/121.15 X 4,693,460 9/1987 Adamson et al. ..... 112/121.15 X 4,817,544 4/1989 Ackermann et al. ..... 112/153

*Primary Examiner*—Werner H. Schroeder

*Assistant Examiner*—David K. Suto

*Attorney, Agent, or Firm*—McGlew & Tuttle

[57] ABSTRACT

A workpiece alignment device for sewing machines for aligning a workpiece fold edge, such as a shirt buttonhole strip. A ruler stop is provided positioned on a sewing machine work surface. An alignment finger is provided connected to a double action cylinder for movement of the finger between a first position and a second position as the flat alignment finger is guided by a guide plate having guide sections extending upwardly such that the flat alignment finger connected to a bow-shaped hook may be moved upwardly and away from the guide ruler and away from the workpiece and downwardly toward the workpiece and guide ruler to engage the folded section to move the folded section into alignment with the ruler stop.

6 Claims, 1 Drawing Sheet

SEWING MACHINE WORKPIECE ALIGNMENT DEVICE

The invention relates to a device for use with a sewing machine for the establishment of edge alignment of a workpiece lying on a contact surface. The edge alignment is established with respect to a ruler stop. Such a device may be used with a workpiece having a fold edge of a seam folded twice and extending along the length of the workpiece such as a shirt buttonhole strip.

BACKGROUND OF THE INVENTION

German Patent No. 21 11 564 describes a device for sewing machines for the alignment of a work piece. The device includes a U-shaped sheet metal holder with a stop for the edge of the work piece. The stop is formed by a bend which cooperates with a flat compression-air nozzle which aims air at the stop. Such an alignment principle works only for work pieces with a relatively small surface. Furthermore, this alignment principle uses relatively large amounts of compressed air.

SUMMARY AND OBJECTS OF THE INVENTION

It is an object of the invention to provide a device on sewing machines for the alignment of a work piece with a folded edge, e.g. on a button hole strip on a shirt front, with which even work pieces with a large surface can be aligned exactly with little effort along a ruler stop.

According to the invention, a workpiece alignment device is provided for use on or with sewing machines in which the workpiece has a fold edge of a seam, folded a first time and a second time (such as a shirt buttonhole strip), the fold edge running a distance between a first and second end of a workpiece. A ruler stop is provided positioned on a sewing machine work surface. Hook-shaped alignment means is provided disposed transversely with respect to the ruler stop for catching the fold edge of the workpiece and for movement between a starting position spaced a distance from the ruler stop and an alignment position adjacent the ruler stop.

Once the work piece to be processed on the sewing machine is slid under an alignment element which is in its starting position and close to the ruler stop, the alignment element is pulled back into its alignment position. The alignment elements hook hooks into the fold edge of the seam and hold the work piece edge in contact with the contact face of the ruler stop, undertaking the final alignment with regard to the ruler stop. Consequently the work piece can be taken over by a work piece clamp. For an even alignment of the entire work piece edge it is advantageous to provide a number of alignment devices depending on the length of the work piece, or to build the alignment element or elements correspondingly wide.

Due to the provision of a guide section of a guide element extending upward at an angle supporting the alignment element from the alignment position to the starting position, the alignment element is lifted when in its starting position, thus the work piece can be slid easily under it in the direction of the ruler stop.

The alignment element is formed of a spring plate that includes a guide plate extending upwardly at an angle in the area of a hook to make the insertion of the work piece easier, in which the alignment element, made a of spring plate, can give way elastically and in which the guide plate which is arranged on the hook at an angle and the carrying surface together form a funnel-shaped guide for the work piece edge.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which a preferred embodiment of the invention is illustrated.

DESCRIPTION OF THE PREFERRED EMBODIMENT

Figure 1:
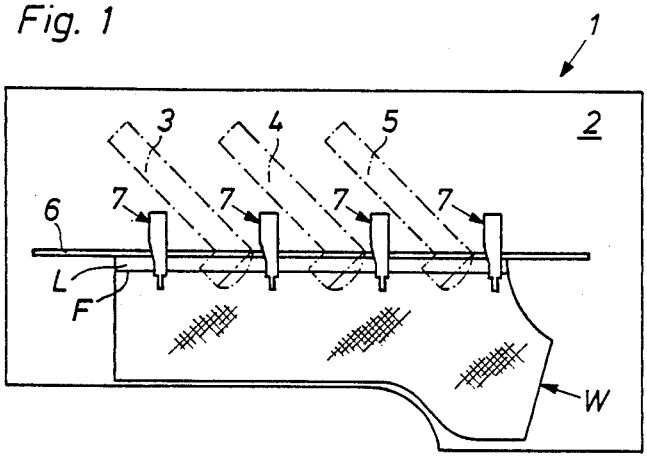
FIG. 1 is a top diagrammatical view of a sewing unit with four alignment devices altogether.
Figure 2:
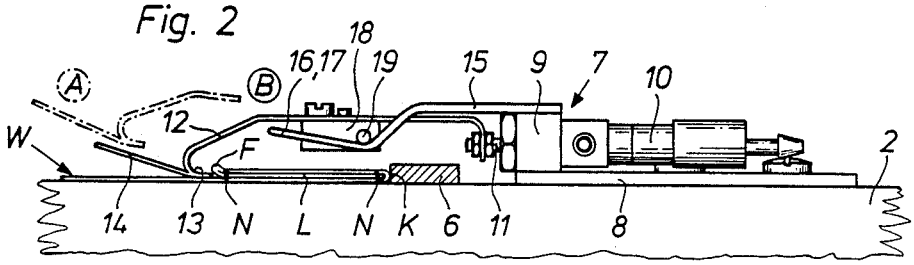
FIG. 2 is a lateral view of an alignment device.
Figure 3:
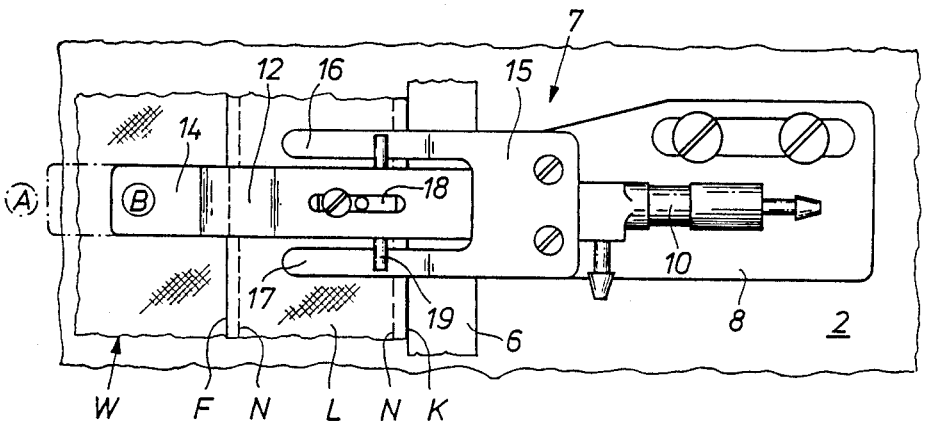
FIG. 3 is a top view of an alignment device.

The sewing unit 1 has a table top work surface 2 on which three sewing machines 3, 4 and 5 (shown in phantom) are arranged at a distance relative to one another. On the table top 2 a ruler stop 6 is provided for the edge K of a work piece W lying on the table top 2.

The work piece W is the front part of a shirt with a strip L formed by a double folded edge and two seams N in which button holes are to be sewn by means of the sewing machines 3, 4, 5. Due to the double folding, the work piece W has a fold edge F running parallel relative to the work piece edge K.

For an edge-true alignment of the work piece W four identical alignment devices 7 are arranged on the table top 2.

Each alignment device 7 has a carrier plate 8 with a holder 9 to be fastened on the table top 2. The holder 9 has a double action compressed-air cylinder 10, whose piston rod 11 is connected to a flat alignment finger 12 made from a spring plate. The free end of the alignment finger 12 is angled downward and ends in a bow-shaped hook 13. The bottom of the hook 13 has a fixed flat guide plate 14 which extends upward at an angle.

The holder has a fork-shaped guide 15 consisting of a plate stiffened against bending, which is provided with two guide sections 16, 17 pointing upward at an angle.

A flat holder 18 having a pin 19 protruding on both sides is fastened to the alignment finger 12. The alignment finger 12 and the guide sections 16, 17 of the guide piece 15 are adjusted relative to one another so that the alignment finger 12 is always supported under bias on the two guide sections 16, 17 via the pin 19.

When the piston rod 11 is extended the alignment finger 12 is in the starting position A (shown in phantom), which the hook 13 is spaced apart from the fold edge F. As in this position of the piston rod 11 the pin 19 is located at the free end of the guide section 16, 17, the hook 13 has a relatively large vertical distance with regard to the table top 2 in the starting position A.

In order to insert a work piece W into the sewing position the alignment fingers 12 of the four alignment devices 7 are in the starting position A. When the work piece W is inserted, its strip L is slid under the lifted alignment fingers 12 until the work piece edge K lies close to the ruler stop 6. Then the compressed-air cylinders 10 are reset, consequently the piston rods 11 are pulled back. During this movement of the piston rods 11 the alignment fingers 12 are pulled from the starting position A shown in a phantom line into the alignment position B shown in solid line. As during this movement the pins 19 slide downward at an angle. The hooks also execute a downward movement at an angle, following a course in which they touch the work piece W just before the fold edge F, and then grip the fold edge F. The carrier plates 8 of the alignment device 2 are adjusted on the table top 2 so that in the alignment position B of the alignment fingers 12 the hooks 13 push the work piece edge K slightly against the ruler stop 6. By this means the work piece edge K, which was before moved manually to the ruler stop 6, is held to the ruler stop or a final edge-true adjustment is made. Once the work piece W is aligned exactly, the strip L can be taken over by a work piece clamp (not shown) provided on each of the sewing machines 3, 4, 5.

While a specific embodiment of the invention has been shown and described in detail to illustrate the application of the principles of the invention, it will be understood that the invention may be embodied otherwise without departing from such principles.

What is claimed is:

1. A device for use on sewing machines for true edge alignment of a workpiece, the workpiece lying on a contact surface relative to a ruler stop, the workpiece having a fold edge of a seam folded twice running at a distance with regard to the workpiece in the form of a shirt buttonhole strip comprising: hook-shaped alignment means for catching on the fold edge, said hook-shaped alignment means being positioned transversely with respect to a lengthwise direction of the ruler stop, said hook-shaped alignment means being movable between a starting position spaced a distance from the ruler stop and an alignment position lying closer to the ruler stop than said starting position.

2. A device according to claim 1, further comprising: a guide including first and second guide sections extending upwardly at an angle for supporting said alignment means along a path from the alignment position to the starting position.

3. A device according to claim 1, wherein said alignment means is formed of a spring plate including a guide plate extending upwardly at an angle, said alignment means including a hook portion positioned adjacent an end of said guide plate.

4. A workpiece alignment device for sewing machines in which the workpiece has a fold edge of a seam, folded a first time and a second time, the fold edge running a distance between first and second ends of a workpiece, comprising: a ruler stop positioned on a sewing machine work surface; and, hook-shaped alignment means for catching the fold edge of the workpiece for movement between a starting position spaced a distance from the ruler stop and an alignment position adjacent the ruler stop.

5. A workpiece alignment device according to claim 4, wherein said hook-shaped alignment means is connected to said sewing machine work surface on a first side of said ruler stop and extends in a direction transverse to said ruler stop to a second side of said ruler stop.

6. A workpiece alignment device according to claim 5, wherein said alignment means includes a guide plate fixed on said first side of said ruler stop, said guide plate extending across said ruler stop and including first and second upwardly extending guide sections, a reciprocating alignment finger connected to a double-acting cylinder on said first side of said stop ruler and having a hook end for engaging the fold edge and an alignment guide plate extending upwardly from said hook end.

* * * * *